US006363218B1

(12) United States Patent
Lowenstein et al.

(10) Patent No.: US 6,363,218 B1
(45) Date of Patent: Mar. 26, 2002

(54) LIQUID HEATER LOAD CONTROL

(75) Inventors: Andrew Lowenstein; Marc J. Sibilia, both of Princeton, NJ (US)

(73) Assignee: AIL Research, Inc., Princeton Junction, NJ (US)

( * ) Notice: Subject to any disclaimer, the term of this patent is extended or adjusted under 35 U.S.C. 154(b) by 0 days.

(21) Appl. No.: 09/232,415

(22) Filed: Jan. 15, 1999

(51) Int. Cl.[7] ..... H05B 1/02
(52) U.S. Cl. ..... 392/498
(58) Field of Search ..... 392/498, 497, 392/454, 464, 461, 500, 329; 219/514, 519, 437; 119/437, 511, 73; 236/91; 337/298; 370/248

(56) References Cited

U.S. PATENT DOCUMENTS 2,927,186 A * 3/1960 Brandl ..... 219/20
4,424,438 A * 1/1984 Antelman et al. ..... 219/491
4,568,821 A * 2/1986 Boe ..... 219/419
4,578,565 A * 3/1986 Dawidowitch ..... 392/452
4,714,821 A * 12/1987 Jakobsson ..... 219/326
4,737,615 A * 4/1988 Stipe ..... 392/454
4,765,351 A * 8/1988 Clary ..... 134/56 D
4,888,495 A * 12/1989 Feron et al. ..... 307/39
4,948,948 A * 8/1990 Lesage ..... 219/329
5,067,170 A * 11/1991 Nagashima et al. ..... 392/461
5,175,792 A * 12/1992 Lefebvre ..... 392/498
5,504,306 A * 4/1996 Russell et al. ..... 219/497
5,686,004 A * 11/1997 Schneider ..... 219/388
5,701,387 A * 12/1997 McGugan ..... 392/456
5,737,316 A * 4/1998 Lee ..... 370/248
5,808,277 A * 9/1998 Dosani et al. ..... 219/481
5,834,741 A * 11/1998 Tseng ..... 219/506
5,956,462 A * 9/1999 Langford ..... 392/449

* cited by examiner

*Primary Examiner*—Teresa Walberg
*Assistant Examiner*—Daniel Robinson
(74) *Attorney, Agent, or Firm*—Watov & Kipnes, P.C.

(57) ABSTRACT

The invention relates to a device for controlling the power consumption of one or more electric resistance heating element in a vessel containing a heatable liquid, at least one inlet for receiving a liquid having a first temperature, at least one outlet for removing liquid having a second higher temperature, and at least one thermostat for directing power to at least one heating element. The device has a detector for detecting one or more predetermined conditions in the vessel relating to the amount of liquid having the second higher temperature remaining in the vessel, and for generating an initiating signal corresponding to the predetermined condition. A controller is responsive to the initiating signal, and is configured for outputting a corresponding switching signal. A power modulator is responsive to the switching signal, and is configured for modulating power to at least one heating element.

5 Claims, 7 Drawing Sheets

LIQUID HEATER LOAD CONTROL

FIELD OF THE INVENTION

The present invention relates generally to electrically heated liquid heaters. More particularly, the present invention relates to methods and device for adjusting electrical power to an electric resistance heating element in the liquid heater in a manner to either reduce its average electrical power or to allow the liquid heater to receive a significant quantity of heat from an auxiliary heat source.

BACKGROUND OF THE INVENTION

A hot water heater typically includes a vertically mounted cylindrical water tank, a cylindrical shell coaxial with and radially spaced apart from the water tank to form an annular space between the outer wall of the water tank and the inner wall of the shell, and insulating at least a portion of the annular space for providing thermal insulation to the water tank. Polymer foam expanded directly within the annular space is an effective insulating material.

The typical water tank has various appurtenances such as inlet, outlet and drain fittings. Especially, the water tank is provided with water heating and temperature control means. Typically for electrically heated water heaters, the water heating means comprises one or more electrical resistance heating elements. Each heating element extends through a fitting in the wall of the water tank such that the resistance heating element is inside the tank and means for connecting the resistance heating element to an electrical power source is outside the tank.

Electric water heaters with storage tanks between 30 and 120 gallons typically have two electric-resistance elements that heat the stored water. One element is located near the bottom of the storage tank and the second is located at a height approximately one-fourth to one-third down from the top of tank. Both elements commonly have the same heating rate. Although elements for 240 V (the voltage at which most 30 to 120 gallon water heaters operate) electric water heaters are available with heating rates between 750 W and 6000 W, 4500 W elements are most commonly installed at the factory. This gives the water heaters a high reheat capability without requiring wiring changes to the building to handle more than 20 A on the water heater's circuit.

The temperature control means for an electrically heated water heater commonly comprises a mechanical thermostat which operates a switch to apply electrical power to the electrical resistance heating element when water in the tank is sensed to be below a selected set point temperature, and operates the switch to disconnect electrical power from the electrical resistance heating element when the water in the tank is at or above the set point temperature. With such temperature control means, electrical power to the electrical resistance heating element is either full on, passing full electrical current, or completely off.

Electric water heaters with storage tanks almost always operate with stratified thermal conditions inside the tank. Hot water is drawn from the top of the tank, while at the same time, cold water enters near the bottom. Since the cold water is more dense than the hot, it tends not to mix with the hotter water above.

Typically, when a hot-water draw occurs, the tank's lower thermostat will be the first to sense the cold water entering the tank. This triggers the lower heating element. If a large volume of hot water is quickly drawn from the tank, the level of cold water within the tank can reach the upper thermostat.

This will simultaneously trigger the upper element and turn off the lower element. The upper element reheats the top 25% to 33% of the tank. Once the upper thermostat has been satisfied (i.e., the top of the tank has been reheated), the upper element turns off and the lower element resumes heating the remainder of the tank.

Electric resistance water heaters are generally simple and inexpensive devices. However, such heaters are expensive to operate and have a very high instantaneous demand for power in comparison to their average power demand.

The US Department of Energy's rating procedure for water heaters assumes a daily average consumption of hot water in residences of 64.3 gallons per day. Assuming that the hot water is heated from 65° F. to 130° F., this usage corresponds to an average daily power of 423 W. However, since a water heater's upper and lower elements are both typically 4500 W, its instantaneous electrical demand will typically be ten times its demand averaged over 24 hours. Furthermore, there is a high level of coincidence in the operation of residential water heaters within the same geographical region. For most homes, hot-water use is highest in the morning when people wake up and take showers. It is common for an electric utility to have an average (or diversified) demand from all the water heaters within its service territory of 1,500 W during weekday mornings. If these water heaters could be controlled so that most never operate at a power much higher than the average required to meet the daily use of hot water, the morning weekday peak could be reduced by about 1,000 W per water heater.

One approach to reducing the operating cost for a water heater is to supplement its operation with an auxiliary heat source such as a desuperheater, a solar thermal collector, a heat pump, and the like. Typically, such a heat source is attached to the water heater so that it draws water from a location near the bottom of the tank, heats the water, and then returns the water to a location near the bottom of the tank.

One of the problems associated with auxiliary heat sources is that their heating rate is typically much lower than the heating rate associated with the resistance elements that come with the water heater. Thus, the heating contribution of such heat sources will be greatly diminished if the resistance elements in the water heater are allowed to simultaneously operate.

SUMMARY OF THE INVENTION

The present invention is generally directed to a device for controlling the power consumption of one or more electric resistance heating elements in a vessel containing a heatable liquid (such as water), at least one inlet for receiving a liquid having a first temperature, at least one outlet for removing liquid having a second higher temperature, and at least one thermostat for directing power to at least one heating element. The device of the present invention comprises detection means for detecting one or more predetermined conditions in said vessel relating to the amount of liquid having said second higher temperature remaining in said vessel, and for generating an initiating signal corresponding to said predetermined condition, controller means responsive to the initiating signal for outputting a corresponding switching signal and power modulating means responsive to said switching signal for modulating power to at least one heating element.

BRIEF DESCRIPTION OF THE DRAWINGS

The following drawings in which like reference characters indicate like parts are illustrative of embodiments of the invention and are not to be construed as limiting the invention as encompassed by the claims forming part of the application.

DETAILED DESCRIPTION OF THE INVENTION

Figure 1:
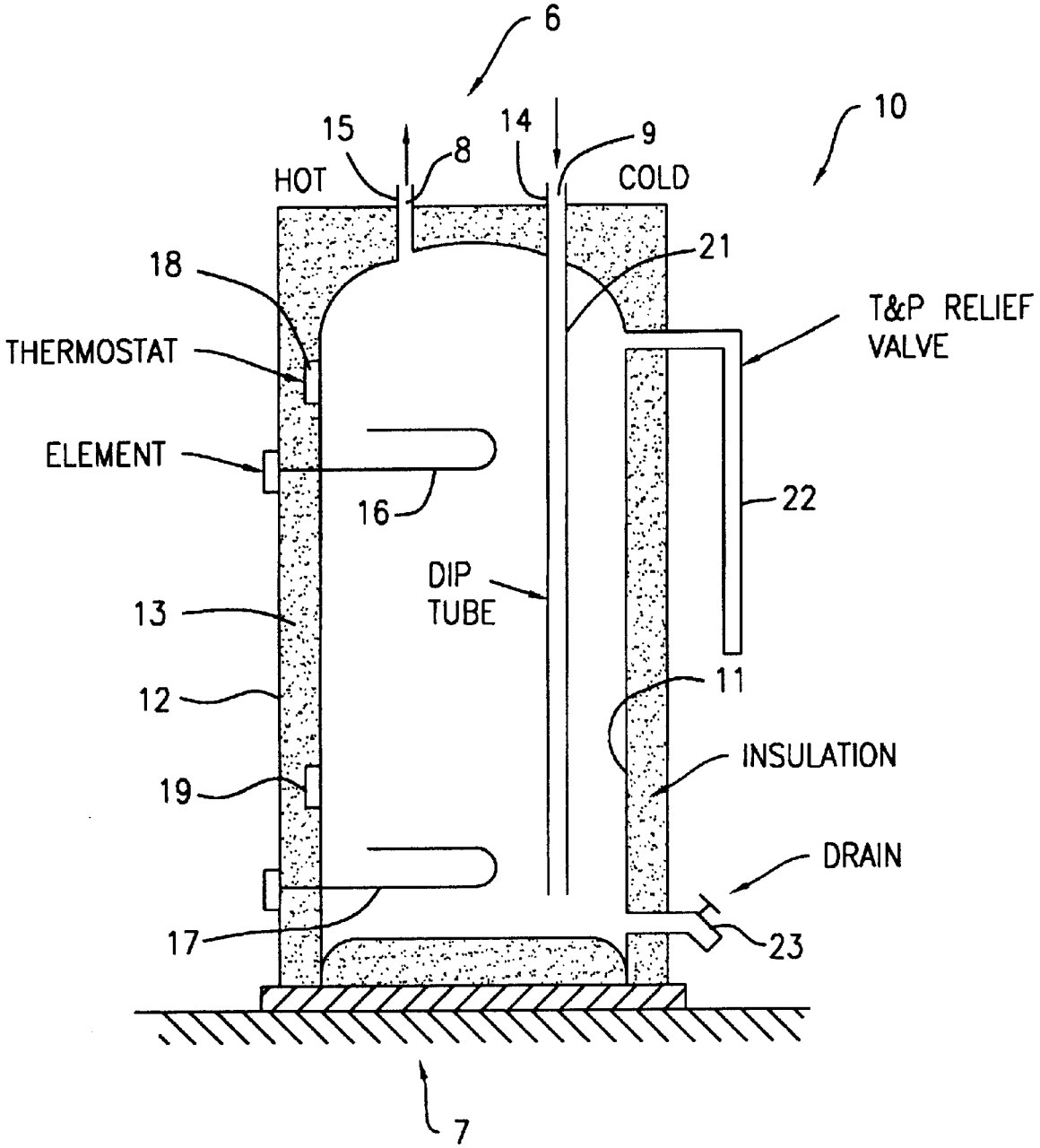
(PRIOR ART) FIG. 1
FIG. 1 is a sectional view of a typical two-element electric resistance water heater, showing the main components of the heater.

Referring to the drawings, particularly to FIG. 1, there is shown a sectional view of a water heater 10 comprising a water tank 11, a shell 12 surrounding the water tank 11, and foam insulation 13 filling the annular space between water tank 11 and shell 12. Water inlet 14 enters the top of water tank 11 for adding cold water near the bottom of the water tank 11 by the dip tube 21. Water outlet line 15 exits water tank 11 for withdrawing hot water from near the top of water tank 11. Resistance elements 16 and 17 extend through the wall of the water tank 11.

Thermostats 18 and 19 are mounted to the water tank 11 to sense the temperature of the water in the corresponding region of the water tank 11. If the water in the water tank 11 is sensed to be below a selected set point temperature, the corresponding thermostat 18 or 19 operates a temperature sensitive switch to allow electrical power through the associated resistance element 16 or 17. Once the water is at or above the set point temperature, the switch in the thermostat 18 or 19 operates to stop electrical power from passing through the resistance element 16 or 17.

When hot water 8 is drawn, the lower thermostat 19 will be the first to sense the cold water 9 entering the water tank 11. This triggers the lower resistance element 17. This is called the "baseload heating" state in which only the lower 67% to 75% of the water tank 11 requires heating. If a large volume of hot water 8 is quickly drawn from the water tank 11, the level of cold water 9 within the water tank 11 can reach the upper thermostat 18. This will simultaneously trigger the upper resistance element 16 and turn off the lower resistance element 17. This is the "incipient runout" state because there is a low amount of hot water 8 in the water heater 11 and the danger of a runout or delivery of low temperature water from the water heater 11 is present. This state can also be referred to as the "quick recovery" state because all the power is focused at the upper resistance element 16 which quickly reheats the top 25% to 33% of the water tank 11.

Once the upper thermostat 18 has been satisfied (i.e., the top of the water tank has been reheated), the upper resistance element 16 turns off. The water heater 10 returns to the "baseload heating" state. The lower resistance element 17 turns on and resumes heating the remainder of the water tank 11 until the set point temperature at the lower thermostat 19 is reached. Once that point is reached the water heater 10 is in the "stand-by" state, and no heating occurs.

Electric resistance water heaters are generally provided with safety devices. A high temperature safety shut off switch (not shown) is installed in the electric power line (not shown) which cuts off power to the electrical resistance element when the temperature in the water tank 11 rises above a safe level. Also, the water tank 11 is provided with a high temperature and pressure relief valve 22 which opens when it detects either excessively high temperature or pressure in the water tank 11. A drain 23 is also provided for regular maintenance purposes.

Figure 2:
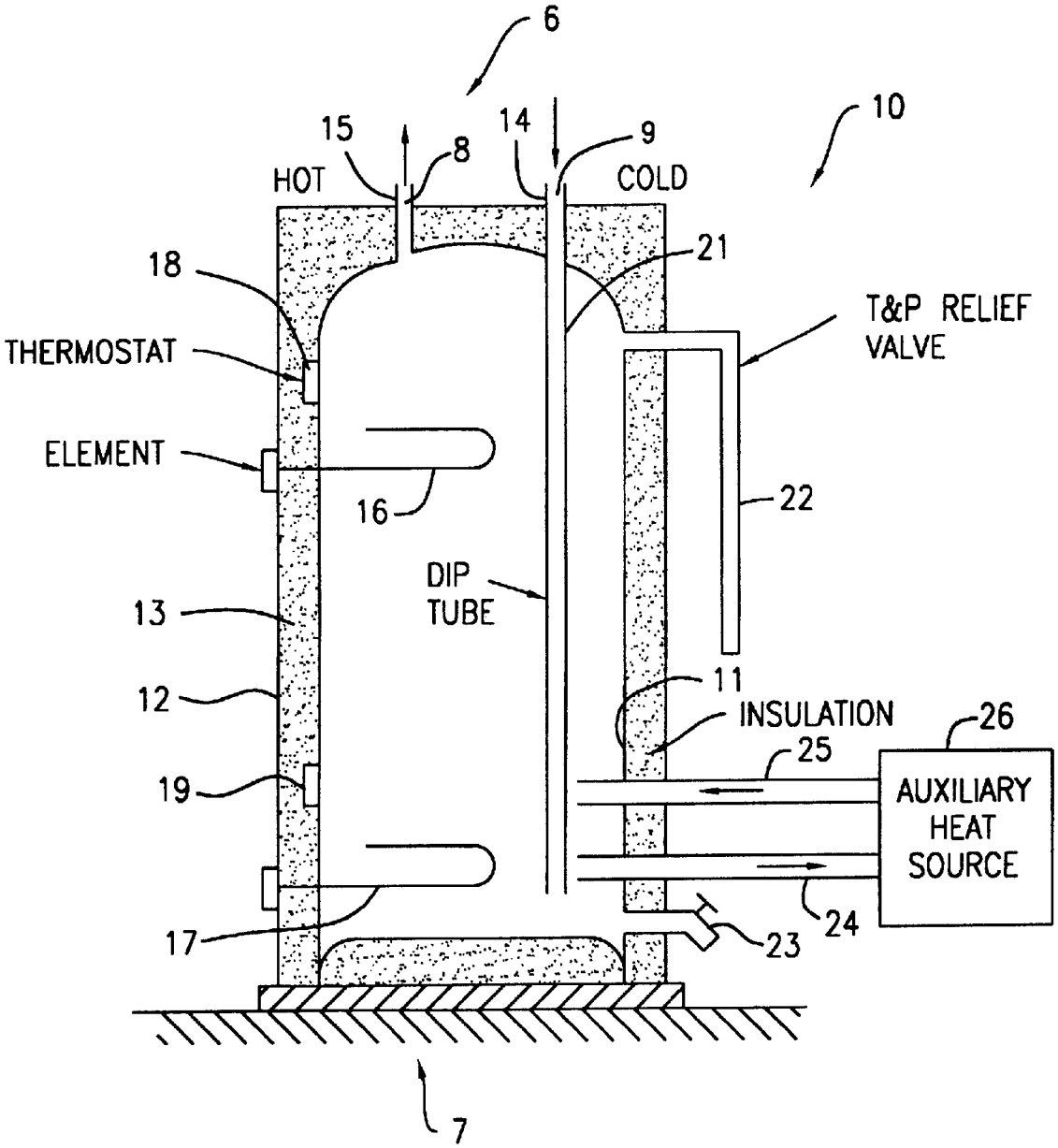
(PRIOR ART) FIG. 2
FIG. 2 is a sectional view of a typical two-element electric resistance water heater, showing the main components of the heater and further including an auxiliary heat source.

FIG. 2 shows the same water heater 10 as the one depicted in FIG. 1 except for the addition of an auxiliary heat source 26. The auxiliary heat source 26 typically includes a water pump (not shown) and a heat exchange means (not shown) for heating water drawn in from the water tank 11 through inlet line 24 and returned back to the water tank 11 through outlet line 25. Auxiliary heat sources come in different forms such as desuperheaters, solar thermal collectors, heat pumps and the like. They are typically connected near the bottom of the water tank 11 to assist the heating of the water. As discussed before, the problem associated with auxiliary heat sources 26 is that their heating rate is typically slower than the heating rate associated with resistance elements 16 and 17. As will be described hereinafter, one embodiment of the invention provides a means to coordinate the resistance elements 16 and 17 and the auxiliary heat source 26 to provide significant heating contribution by the auxiliary heat source 26.

Figure 3:
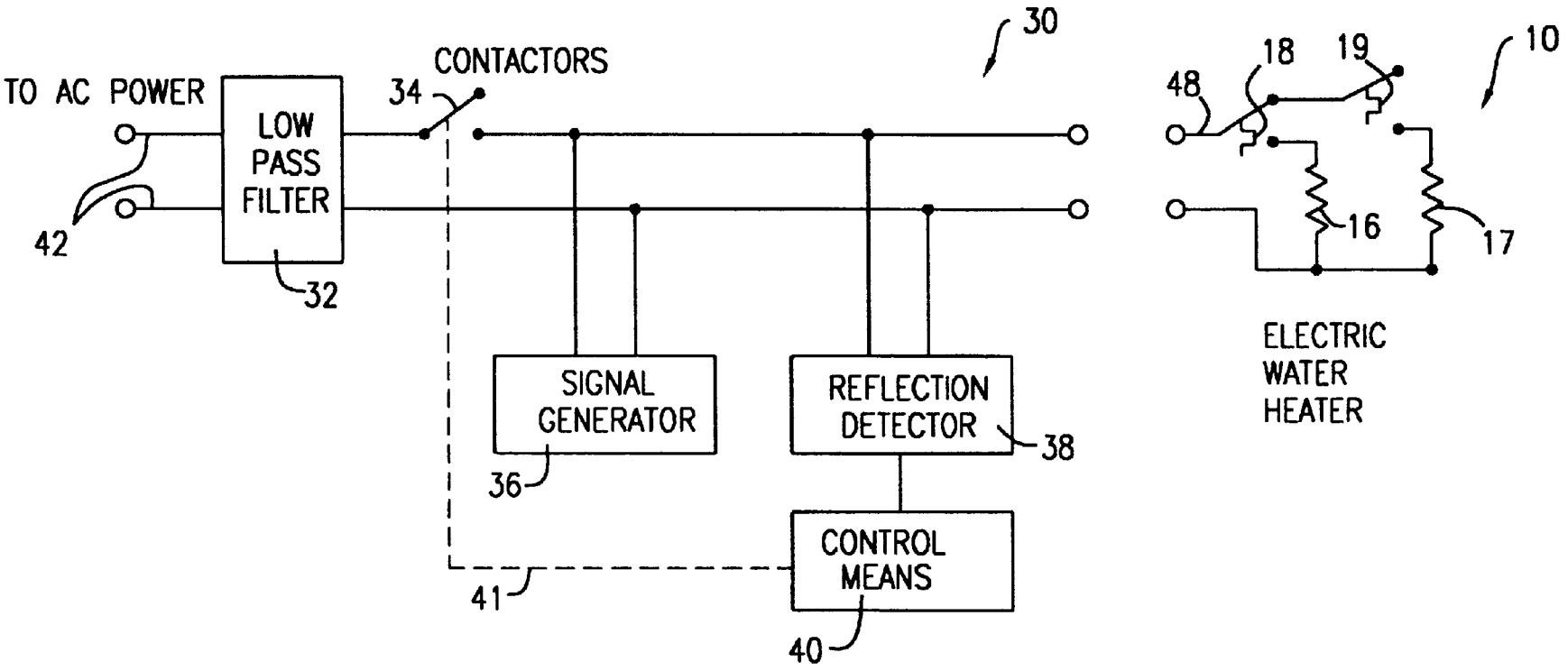
FIG. 3 is a functional block diagram of a water heating system incorporating a preferred load controller of the present invention.

Referring to FIG. 3, one embodiment of a load control device 30 in accordance with the principles of the present invention is shown. The load control device 30, referred to as a "device" hereinafter, is especially useful in modulating the power consumption of the resistance elements 16 and/or 17 in the water heater 10. In this embodiment, the device also detects the operating state of the water heater 10 ("baseload", "incipient runout" or "stand-by") and uses this information to modulate the average power consumed by the resistance elements 16 and/or 17 to a low value, while still meeting the demand for hot water as will be described hereinafter.

The device 30 can be implemented with water heaters having more than two resistance elements and functions in the same manner as with two resistance element water heaters. One group of resistance elements would be designated as meeting the "baseload demand" (i.e. lower resistance element 17) and the other group of elements would be designated as "quick recovery demand" (i.e. upper resistance element 16). As will be further described hereinafter, the operation of the quick recovery demand group could be used to determine when the system is having trouble delivering adequate hot water. The baseload demand group would have its power modulated to the lowest value that avoids runouts or delivery of relatively cold water.

FIG. 3 depicts the placement and connection of the device 30 in relation to the water heater 10. The device 30 is coupled to the power leads 48 to the water heater 10. This allows the device 30 to be connected to the water heater 10 without having to modify the existing tank circuit. The device 30 includes a signal generator 36, a reflection detector 38, a controller 40, a relay switch or contactor 34 and a low pass filter 32. The low pass filter 32 is coupled to the power supply line 42 at the outset to prevent the high-frequency electrical signals produce by the signal generator 36 from being transmitted onto the power supply line 42.

The signal generator 36 and the reflection detector 38 are each coupled to the power supply line between the low pass filter 32 and the water heater 10. The controller 40 is coupled to the output of the reflection detector 38. The relay switch 34 carries and interrupts power to the water heater 10 under the control of the controller 40 through output line 41.

The operation of the preferred embodiment of the device 30 of the present invention will now be explained with references to FIGS. 1 and 3. In this embodiment, information about the operational state of the thermostats 18 and 19 is used to limit the amount of time that the water heater 10 operates in the "incipient runout" state, thereby reducing the probability that the water heater 10 will run out of hot water.

During the operation of the device 30, the signal generator 36 is continuously transmitting a periodic signal (such as a square wave) along the power leads 48 to the water heater 10. As the thermostats 18 and 19 open and close, the impedance across the water heater 10 circuit changes and in turn changes the reflection of the periodic input signal. The reflection detector 38 analyzes the signal reflected from the water heater 10 to determine which operational state the water heater is in.

A preferred method called time-domain reflectometry requires the application of a low-current short rise-time pulse across the two electrical leads to the water heater. This pulse travels down the leads and is reflected when it encounters changes in electrical impedance. Both the shape and time of the reflected signal or waveform will change according to the impedance encountered by the input pulse signal. The reflected signal or waveform that returns to the detector 38 when either the upper thermostat 18 is on or just the lower thermostat 19 is on are sufficiently different to reliably distinguish the state of the water heater 10 (i.e. baseload heating, quick recovery, stand-by) using low cost circuits. Since the operating states for a water heater will almost always occur in a predictable sequence (i.e., "stand-by" to "baseload" to "quick recovery" to "baseload" to "stand-by"; or "stand-by" to "baseload" to "standby") and the "stand-by" state is easily distinguished when the water heater 10 draws no current, each operating state can be associated with reflected waveform shape.

Another detection method is called spectral detection where a low level signal at one or more frequencies is applied and changes in the frequency dependent input impedance is detected. As an example, the signal generator 36 alternately applies low-power sinusoidal current signals at 5 Mhz, 10 Mhz, 20 Mhz and 40 Mz onto the power leads 48 to the water heater 10. The reflection detector 38 using synchronous detection means measures the amplitude and phase angle of the voltage signal that is reflected by the water heater 10 for each frequency of input current signals. These amplitudes and phase angles will be depend on whether the water heater 10 is in the "stand-by", "baseload" or"quick recovery" state. Changes in the measured amplitudes and phase angles indicates that the water heater 10 has changed operating states. Since the operating states for a water heater will almost always occur in a predictable sequence (i.e., "stand-by" to "baseload" to "quick recovery" to "baseload" to "stand-by"; or "stand-by" to "baseload" to "stand-by"), each operating state can be associated with a set of measured amplitudes and phase angles. Although the preceding measurement can be made at one frequency, the use of four frequencies insures that differences in frequency-dependent input impedances for different water heaters will always be detected.

When the reflection detector 38 detects that the water heater 10 is in the stand-by state, the controller 40 reduces the set point for the average power of the lower resistance element 17. For example, this set point could be reduced as an exponential function in time that decreases to half its value every 12 hours.

When the reflection detector 38 detects that the water heater 10 is in baseload heating, the controller 40 again reduces the set point for the average power of the lower resistance element 17. When the water heater 10 is in either the "baseload" or "stand-by" states, the rate at which the set point is reduced could be the same.

However, if the water heater 10 remains in the "baseload" state for a very long time, the water heater 10 may be having trouble meeting the demand for hot water. To reduce the probability that the water heater 10 will run out of hot water, it is desirable to increase the set point for the average power of the lower element 17 when the reflection detector 38 detects extended operation in the "baseload" state. For example, if the water heater is in the "baseload" state for more than 12 hours, the set point for the average power of the lower resistance element 17 is exponentially increased so that it doubles every four hours.

When the reflection detector 38 detects that the water heater 10 is in "quick recovery" heating (i.e., the "incipient runout" state), the water heater 10 is close to running out of hot water (or it has already run out of hot water). When this state is detected, the controller 40 increases the set point for the average power of the lower element 17. For example, the power set point to the lower element 17 is increased according to a function that has one term that is proportional to time and a second term that is proportional to time squared (e.g., $C1*time+C2*(time)^2$). The inclusion of the term that is proportional to time squared makes the adjustment more rapid during longer runs of the upper element 16, for example, 40 minutes of upper element 16 operation will cause the set point for the lower element 17 to be set at full operating power during baseload heating.

When the water heater 11 is in "baseload" heating (i.e., the lower thermostat 19 is on) the controller 40 will adjust the average power supplied by the lower resistance element 17 so that it equals the set point. This adjustment is made by opening and closing the contactor 34 so that power is periodically applied to the water heater 10. For example, the contactor 34 remains closed for a fraction of every fifteen minute interval. If the set point for the power to the lower element 17 is 50% of the element's maximum power, the contactor 34 would remain closed for 7.5 minutes. Cycling the contactor open and closed over an interval no longer than 15 minutes is particularly useful because electric utilities will frequently bill commercial customers a monthly charge that depends on the customer's maximum power use averaged over fifteen minutes.

The device 30 may be modified to utilize other power adjustment methods such as modulating the applied voltage or current to the water heater 10.

it is understood that the controller 40 may be modified to selectively the power to either the upper element 16 only, the lower element 17 only or both elements 16 and 17. The adjustment of the power set point for the upper element 16 is not preferred, though the controller 40 can be easily modified to do so, if the user's needs require. It is not generally preferred because during impending runouts, it becomes imperative to heat the water that is leaving the tank 11 and any decrease in power to the upper element 16 would be detrimental to the ability of the water heater to deliver hot water rapidly during such conditions.

Figure 4:
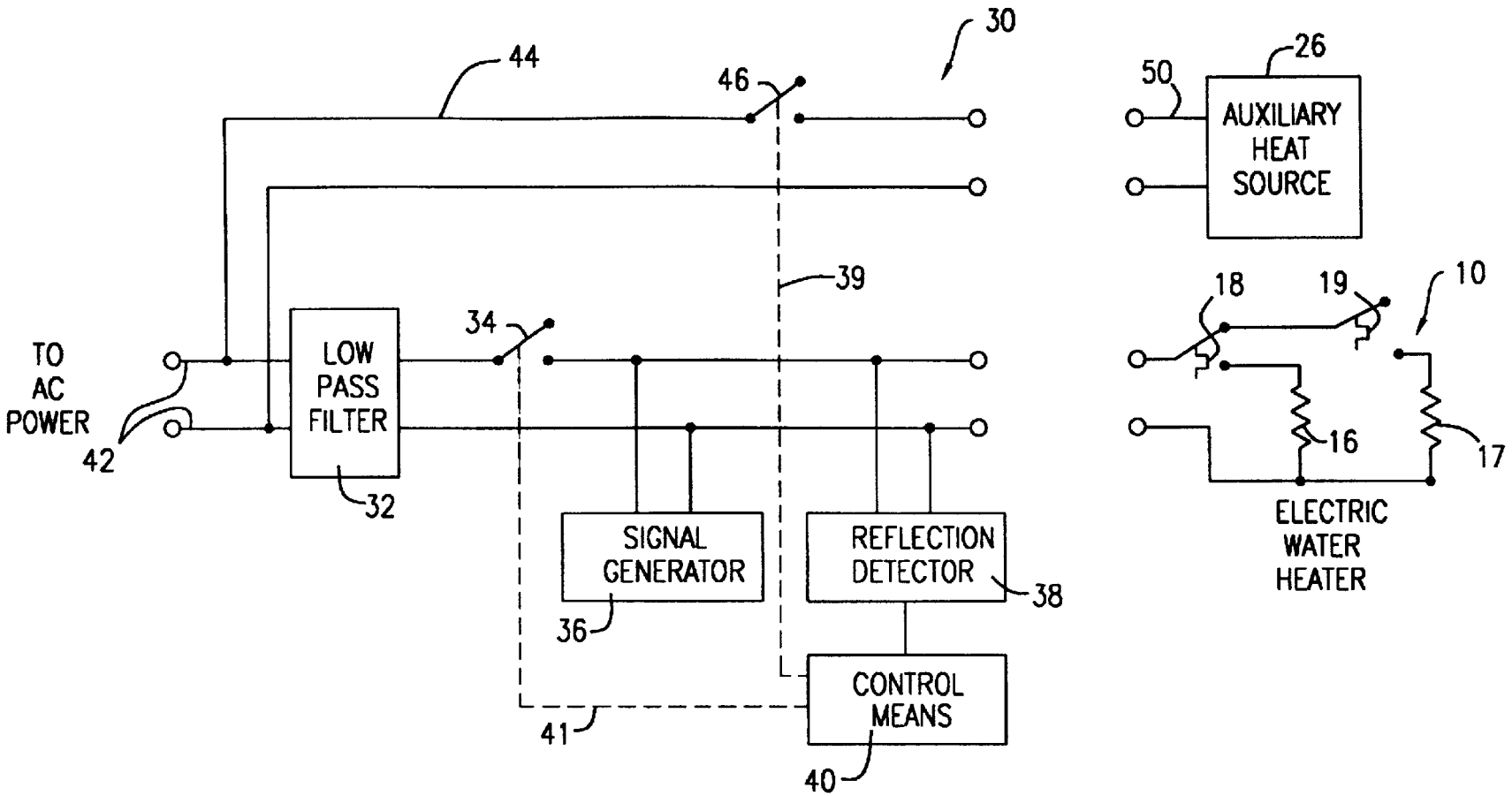
FIG. 4 is a functional block diagram of a water heating system incorporating an alternate embodiment of a load controller of the present invention.

FIG. 4 illustrates an alternate embodiment of the device 30. The basic circuit is similar to the embodiment shown in FIG. 3. In this embodiment, the controller 40 is modified to include an additional output terminal to a second relay switch 46 that can interrupt or supply power to the auxiliary heat source 26. The device 30 effectively controls the heating activity of the auxiliary heat source 26. In this manner, the device 30 can coordinate the respective heating contributions of the auxiliary heat source 26 and the resistance elements 16 and 17.

The operation of the embodiment shown in FIG. 4 is essentially the same as the embodiment depicted in FIG. 3. The device 30 of FIG. 4 can switch the auxiliary heat source 26 on during baseload heating (i.e. lower thermostat 19 is on). During baseload heating the controller 40 can reduce or turn off the power consumption of the lower element 17 to permit the auxiliary heat source 26 to contribute the bulk or all of the heating needs. If the heating by the source 26 is inadequate to prevent run outs, the power set point of the lower element 17 is raised accordingly, as the feedback control steps described above. If the heat source 26 provides heat at a cost that is lower than that of the water heater 10, the device 30 will reduce the cost of heating water by increasing the fraction of heat required for water heating that is provided by heat source 26.

In this embodiment, if the auxiliary heat source 26 is a heat-pump water heater, the device 30 can be used to run the heat-pump water heater and disconnect power to the lower element 17 when the reflection detector 38 detects that the lower thermostat 19 is closed, and disconnect the heat-pump water heater and apply power to the upper element 16 when the upper thermostat 18 is closed. This will allow a water heater 10 to be heated by a heat-pump water heater during the base-load state while solely using the upper resistance element 16 during the quick recovery state.

In an alternate embodiment of the invention, a temperature sensor is either attached to the wall of the water tank 11 or inserted into the water tank 11 through either the hot water outlet 15, cold water inlet 14, or other fitting on the tank. The temperature sensor is located so that it measures the temperature of the water in the upper region of the water tank 11. Since the water temperature in the upper region of the tank will decrease when the water heater 10 is approaching a run-out condition, the temperature measured by this sensor can be used by the controller 40 to modulate the power to the resistance elements 16 and/or 17 to levels that are low but sufficient to prevent a run-out condition.

In another alternate embodiment of the invention, a meter measures the water flow either into or out of the water heater 10. This measurement of water flow is then used by the controller 40 to calculate whether the water heater 10 is approaching a run-out condition. Once again, the controller 40 would modulate the power to the resistance elements 16 and/or 17 to levels that are low but sufficient to prevent a run-out condition. This embodiment would be more effective if sensors were added to measure the cold inlet water 9 and hot outlet water 8 temperatures and their measurements sent to the controller 40. The controller 40 would then calculate the energy required to heat the water and compare it to the energy provided by the resistance elements 16 and 17.

Figure 5:
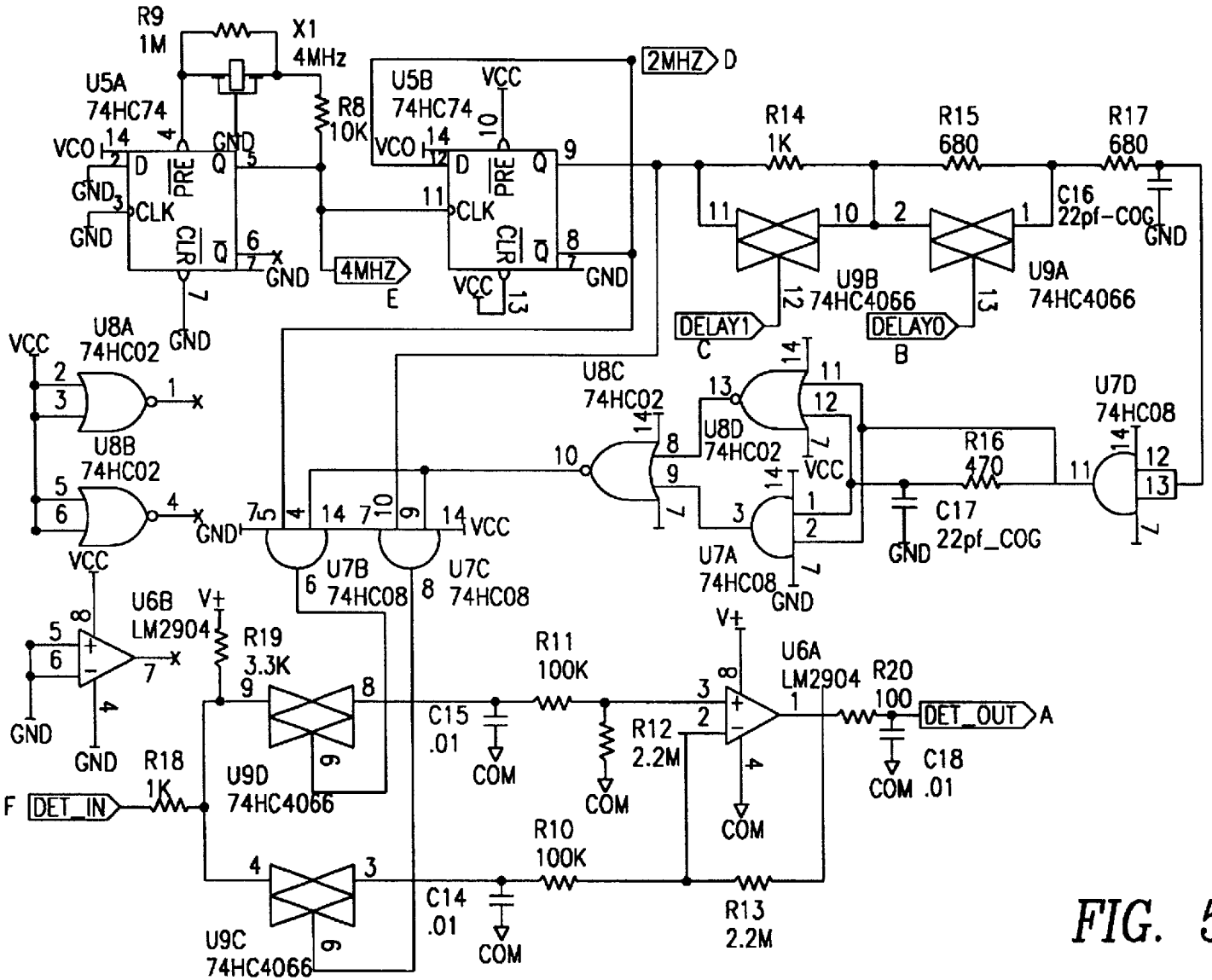
FIGS. 5–6 collectively show a detailed circuit schematic diagram of various components of the present invention.
Figure 6:
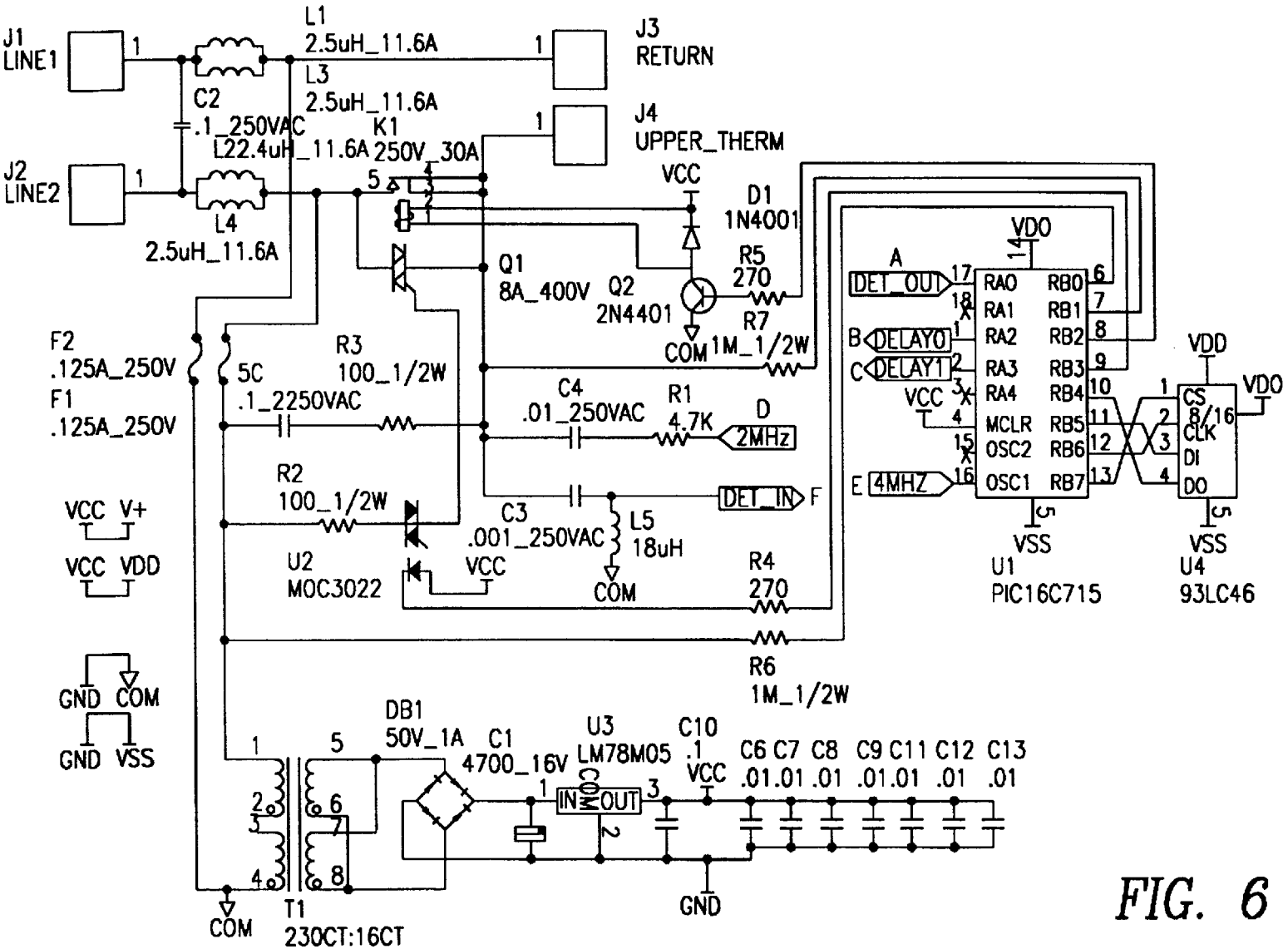
Figure 7:
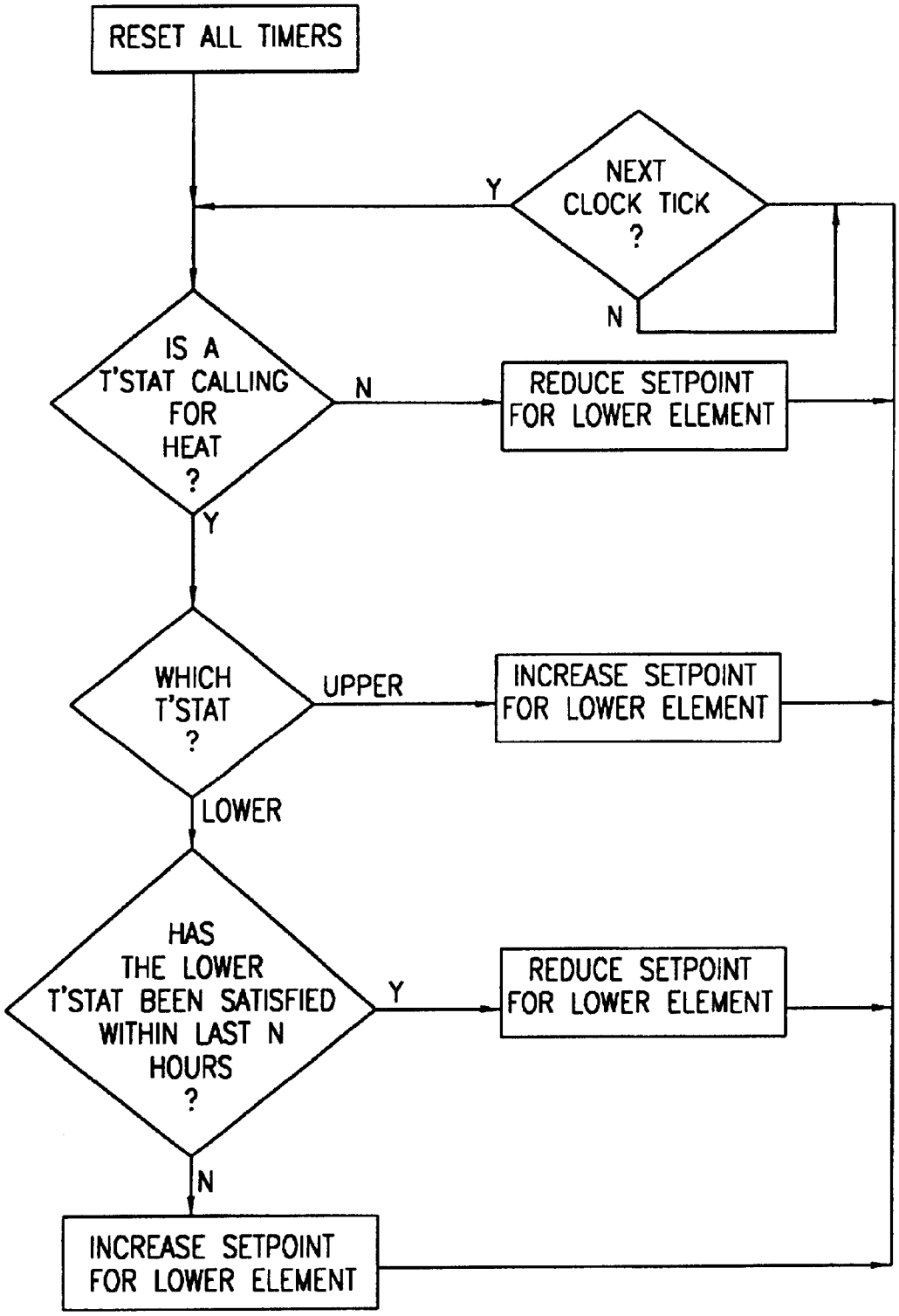
FIG. 7 is flowchart illustrating the operation of the present invention.

Referring now to FIGS. 5 and 6, the preferred embodiment of FIG. 3 utilizing time-domain reflectometry for detecting the states of the water heater 10, is shown in specific detail with parts numbers identified as appropriate. The device 30 consists of five main components: a power supply, a power relay assembly 34, a signal generator 36, a signal detector 38, and a microprocessor controller 40.

The power supply is a conventional transformer isolated regulated 5 volt power supply. It includes components F1, F2, T1, DB1, C1, U3, and C6 through C13. The power relay assembly includes a low pass filter 32 consisting of L1 through L4 and C2. This filter prevents the signal superimposed on the water heater power leads 48 from being applied to the power supply line 42 and causing electromagnetic interference. It also isolates the signal generator 36 at high frequency from low line impedance. Relay K1 carries and interrupts power to the water heater 10. Triac Q1 is turned on momentarily each time K1 is opened or closed to prevent contact arcing, thereby prolonging the life of the relay K1. Q1 is triggered by optoisolator U2. Transistor Q2 provides the drive current for the relay coil of relay K1.

The signal generator consists of a flip-flop U5A being operated as an inverter to drive ceramic resonator X1. The 4 MHZ output drives the clock input of the microprocessor and flip-flop U5B which ensures 50% duty cycle and splits the 2 MHZ resultant into opposite phases for the detector circuit. The 2 MHZ signal is also applied to the output terminal of the controller U1 through current limiting resistor R1 (providing about 1 ma of signal injection) and low frequency AC and DC blocking capacitor C4.

The signal detector 38 is a gated synchronous detector which will measure the voltage generated across the water heater 10 by the injected signal current at a number of different delays from the transition of a 2 MHZ square wave. Four different time delays can be generated by R14, R15, R17 and C16 depending on which of R14 and R15 are shorted by analog switches U9A and U9B. Component U7D buffers and squares the delayed signal, and U8C, U7A, U8D, R16 and C17 form a 15 nanosecond pulse generator. These delayed pulses alternately connect C14 and C15 to the water heater 10 through high pass filter C3–L5. This acts to sample the voltage caused by the applied signal while rejecting noise at other frequencies. The difference in voltage caused by the applied voltage between C14 and C15 is amplified by U6A. Although the signals are sampled in the 10 to 200 nanoseconds time scale, the output of the detector is smooth and responds in about 5 milliseconds.

The microprocessor U1 digitizes the output of the detector with an internal analog to digital converter. It also controls the triac, the relay, and the delay selectors of the signal detector. All the software for decoding changes in the detector signatures resides in the microprocessor. EEPROM U4 provides non-volatile memory for carrying information about operation through power failures.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A device for controlling the power consumption of a liquid heater having at least one inlet for receiving a heatable liquid having a first temperature, at least one outlet for removing the heatable liquid having a second higher temperature, an upper electric resistance heating element, a lower electric resistance heating element, a power supply line for delivering electrical power to each of the electric resistance heating elements, and a first thermostat for sensing the temperature of the heatable liquid in proximity to the upper electric resistance heating element and a second thermostat for sensing the temperature of the heatable liquid in proximity to the lower electric resistance heating element, each thermostat acting as an on/off switch that is open when the temperature of the liquid that it senses is above a set-point value and closed when the temperature of the liquid is below a set-point value, and the thermostats arranged so that when the upper thermostat is closed no heating can be done by the lower resistance heating element, said device comprising:

detection means for detecting the amount of time the first thermostat is in the on state or off state, and for generating a first signal corresponding to the amount of time;

controller means responsive to said first signal, and comprising means for determining a set-point value for an average heating rate of the lower electric resistance heating element; and power modulating means for modulating power to the lower electric resistance heating element so that the average power delivered by the lower electric resistance heating element equals said set point value.

2. The device of claim 1, wherein said detection means comprises:

means for applying an electrical test signal to the liquid heater through the power supply line;

means for detecting the test signal after the test signal has interacted with the thermostats; and means for interpreting the detected test signal to indicate the the amount of time the upper electric resistance heating element is in the on state or the off state.

3. The device of claim 1, wherein said liquid heater further comprises:

an auxiliary source of heat external to the vessel; and means responsive to the first signal from the detection means for turning the auxiliary source of heat on or off.

4. The device of claim 3 wherein the said auxiliary source of heat is a heat pump.

5. The device of claim 3 wherein the said auxiliary source of heat is a solar water heater.

* * * * *